US012209491B2

(12) United States Patent
Ellis et al.

(10) Patent No.: US 12,209,491 B2
(45) Date of Patent: Jan. 28, 2025

(54) AUTOMATED SAND DUMP SYSTEM FOR OIL AND GAS WELLS

(71) Applicant: ADS Services, LLC, Midland, TX (US)

(72) Inventors: Brian Ellis, Spring, TX (US); Scott Charles, Houston, TX (US); John Thomas Scarborough, Jersey Village, TX (US)

(73) Assignee: ADS Services, LLC, Midland, TX (US)

( * ) Notice: Subject to any disclaimer, the term of this patent is extended or adjusted under 35 U.S.C. 154(b) by 0 days.

(21) Appl. No.: 18/125,104

(22) Filed: Mar. 22, 2023

(65) Prior Publication Data

US 2023/0313660 A1 Oct. 5, 2023

Related U.S. Application Data

(60) Provisional application No. 63/322,637, filed on Mar. 22, 2022.

(51) Int. Cl.

| | |
|---|---|
| ***E21B 43/34*** | (2006.01) |
| ***E21B 34/02*** | (2006.01) |
| ***E21B 43/12*** | (2006.01) |

(52) U.S. Cl.

CPC ..... *E21B 43/35* (2020.05); *E21B 34/025* (2020.05); *E21B 43/12* (2013.01)

(58) Field of Classification Search

CPC .. B01D 21/302; B01D 21/245; B01D 21/267; B01D 2221/04; E21B 43/35; E21B 34/025; E21B 43/12; E21B 43/2607; E21B 21/065

See application file for complete search history.

(56) References Cited

U.S. PATENT DOCUMENTS

| | | | | |
|---|---|---|---|---|
| 2004/0020860 | A1* | 2/2004 | Schmigel | B01D 21/32 210/744 |
| 2020/0155975 | A1* | 5/2020 | Hickie | B01D 21/267 |
| 2021/0299595 | A1* | 9/2021 | Malone | B01D 21/32 |
| 2021/0355785 | A1* | 11/2021 | Ahmari | E21B 34/025 |
| 2021/0363029 | A1* | 11/2021 | Johns | B01D 21/302 |
| 2022/0154568 | A1* | 5/2022 | Fink | F25J 1/0284 |
| 2022/0184532 | A1* | 6/2022 | Pitcher | G01N 29/036 |
| 2023/0002247 | A1* | 1/2023 | Johns | B01D 21/307 |
| 2023/0025302 | A1* | 1/2023 | Sayers | E21B 43/35 |
| 2024/0024801 | A1* | 1/2024 | Coombe | B01D 21/267 |

* cited by examiner

*Primary Examiner* — Kipp C Wallace

(57) ABSTRACT

An automated sand dump system for oil and gas wells is provided that uses sensed parameters to determine and effective sand level within a sand trap. When the control system determines that the effective sand level reaches a predetermined level, an automated dump sequence is executed.

10 Claims, 11 Drawing Sheets

400

600

AUTOMATED SAND DUMP SYSTEM FOR OIL AND GAS WELLS

CROSS-REFERENCE TO RELATED APPLICATIONS

This application claims benefit of U.S. Provisional Application No. 63/322,637, filed Mar. 22, 2022, entitled AUTOMATED SAND DUMP SYSTEM FOR OIL AND GAS WELLS, the specification of which is incorporated by reference herein in its entirety.

TECHNICAL FIELD

The following disclosure relates to systems for separating sand and other solids from hydrocarbons and water produced by oil and gas wells, and more particularly to automated systems for controlling the removal of sand from high-pressure separation vessels used in oil and gas well production.

BACKGROUND

A well that has recently been fracked with a mix of sand and frack fluid will produce significant sand for a time before it is producing fluids suitable to send to a pipeline or production facility. Therefore, the initially-produced fluids must be scrubbed of most of the returned frack sand so it does not plug or damage downstream equipment.

Sand separators, also called "sand traps," of different types (e.g., Ball, cyclonic, etc.) and different pressure ratings (e.g., 5-15 kpsi pressure rating) are in use today to capture the mix of sand, water and hydrocarbon fluids flowing from the well. The gas will normally flow right through the trap, as might the oil if the sand trap is designed for such an application. The captured materials will separate in the sand trap with the most dense materials (e.g., sand and rock) settling in the bottom followed (moving upward from the bottom) by water, and then oil, and then gas.

The sand accumulating in a sand trap is often emptied manually, i.e., by an operator that opens a valve at the bottom of the sand trap and flows the material out until it is thought the trap is mostly empty of sand and (preferably) without sending oil and gas to the sand disposal tank. This procedure must be performed every few minutes, hours or days depending on the produced material mix from the well(s). In a manual system, it can be difficult for the operator to balance between dumping too little sand on each dump, thus requiring more frequent dumps, versus dumping too much sand on each dump and sending valuable oil or gas into the disposal tank, or worse yet, releasing gas into the sand storage tank.

There are systems in the market today that attempt to monitor the fluid and sand inflowing from the well prior to separation via sand sensor such as: 1) Green's E.G. Acoustic Sand Monitor Device; 2) Coriolis; and 3) other sand-in-fluids detection systems in development. But to date none of these systems have been successful in accurately predicting the sand volumes produced and captured in any given trap system.

SUMMARY

To truly automate and make the sand dump operation autonomous, the control system must determine what is going on inside the high pressure 1,000-15,000 psi sand trap so as not to over fill it and to avoid emptying the trap completely and releasing gas into the dump line, or understand the material flowing out the bottom into the dump line so as to avoid emptying the trap completely and releasing gas into the dump line. Also, the system can estimate the time it takes to fill the trap utilizing sensor data from dump cycles if no information is available on what is building inside the sand trap. It is a very harsh environment and beyond the capabilities of most commercial off the shelf sensoring solutions.

What is described here is an automated produced sand capture, monitoring and dumping system capable of autonomous operation.

The system can include a production choke or chokes (i.e., on the wellhead) to control the flow and pressure coming from the well to the sand, fluids and gas separation equipment and may be incorporated in the system controls.

In some embodiments, the production choke may be adjusted to ensure the separation and handling capacity of system is not exceeded for the produced liquids, gases and sand.

In some embodiments, the well and multi-well sand trap system can be configured to use only the portions of the system needed depending on the volume of sand, gases and liquids being produced. In some embodiments, it can be configured to operate with reduced capacity if a system component is damaged.

The system can be adapted to support one or many wells on a given well pad site. The details provided herein are primarily focused on a one-well system, with the understanding it can be expanded to cover several wells simultaneously with one or several systems.

In some embodiments, the system can monitor flow rate and hence estimate the mass of sand being produced over set periods of time, e.g., minutes, hours and days typically, and/or mass of sand produced as a function of flow volume gallons.

In some embodiments, automation of the system allows for 24/7 operation with minimal personnel on location creating significant cost savings.

The system can include sensors on the choke/choke discharge line to determine when to close the dump valve by monitoring the transition from sand to water to oil and shutting off flow before fluid flow is complete to prevent discharge of wellbore gases to the atmosphere.

The system can include sensors on the sand trap to determine when to close the dump valve by monitoring the transition from sand to water to oil and shutting off flow before fluid flow is complete to prevent discharge of wellbore gases to the atmosphere.

In one aspect, an automated sand dump system for an oil and gas well is provided, the well comprising a production wellhead for routing sand-bearing hydrocarbon fluids and water from the well into a production line. The automated sand dump system comprises a sand trap vessel having an outer wall defining an exterior on an outer side and an interior cavity on an inner side, the sand trap vessel further including a production inlet for receiving sand-bearing hydrocarbon fluids and water from a production line into an upper portion of the interior cavity, a production outlet for releasing hydrocarbon fluids and water from the upper portion of the interior cavity, and a sand dump outlet for releasing sand from a lower portion of the interior cavity. An automated sand dump choke valve is operably connected to the sand dump outlet to control the release of sand from the lower portion of the interior cavity by opening to release sand from the lower portion of the sand trap vessel and by closing to prevent the release of sand from the lower portion of the sand trap vessel. The system further comprises a control unit including a processor, a memory, a communications interface, a display screen and a human-machine interface (HMI), all being operably interconnected to one another. At least a first sensor is operably attached to the sand trap vessel for measuring a first condition at the sand trap and producing a first sensor signal indicative of the first condition. At least the first sensor is operably connected to the control unit to provide the first sensor signal to the control unit. The processor evaluates at least the first sensor signal to produce a first reported value. The processor compares the first reported value to at least a first predetermined value stored in the memory to determine an effective sand level. When the processor determines that the effective sand level has exceeded a predetermined sand level stored in the memory, the processor directs the control unit to execute a sand dump sequence. When executing a sand dump sequence, the control unit sends a first dump command to open the automated sand dump choke valve and subsequently sends a final dump command to close the automated sand dump choke valve.

In one embodiment, the automated sand dump system further comprises a second sensor operably attached to the sand trap vessel for measuring a second condition at the sand trap and producing a second sensor signal indicative of the second condition. The second sensor is operably connected to the control unit to provide the second sensor signal to the control unit. The processor evaluates both the first sensor signal and the second sensor signal to produce the first reported value.

In another embodiment, the first sensor is a first pressure sensor operably attached to the production inlet and the first condition is an inlet pressure of the sand trap vessel and the second sensor is a second pressure sensor operably attached to the production outlet and the second condition is an outlet pressure of the sand trap vessel. The processor evaluates both the first sensor signal and the second sensor signal to produce a reported differential pressure value as the first reported value. The processor determines the effective sand level by comparing the reported differential pressure value to a minimum differential pressure value stored in the memory as the first predetermined value.

In yet another embodiment, the processor determines the effective sand level by comparing the reported differential pressure value to the minimum differential pressure value and a maximum differential pressure valued store in the memory as a second predetermined value.

In a further embodiment, the first sensor is a first acoustic noise sensor operably attached to the production inlet and the first condition is a first noise level produced by sand moving through the production inlet and the second sensor is a second acoustic noise sensor operably attached to the production outlet and the second condition is a second noise level produced by sand moving through the production outlet. The processor evaluates both the first sensor signal and the second sensor signal to produce a reported differential noise level as the first reported value. The processor determines the effective sand level by comparing the reported differential noise level value to a minimum differential noise level value stored in the memory as the first predetermined value.

In a still further embodiment, the processor further determines the effective sand level by comparing the reported differential noise level value to the minimum differential noise level value and a maximum differential noise level value store in the memory as a second predetermined value.

In another embodiment, the processor uses the first sensor signal to determine a respective volume of sand entering the sand trap vessel during each respective time interval of a plurality of time intervals and sums the respective volumes of sand to provide the total volume of sand entering the sand trap vessel for the plurality of time intervals.

In yet another embodiment, the first sensor is a first acoustic noise sensor operably attached to the production outlet and the first condition is a first noise level produced by sand moving through the production outlet. The processor evaluates at least the first sensor signal to produce a reported outlet noise value as the first reported value. The processor determines the effective sand level by comparing the reported outlet noise value to at least a first predetermined outlet noise value stored in memory as the predetermined value.

In still another embodiment, the production wellhead further includes an automated production choke for controlling the volume of sand-bearing hydrocarbon fluids and water released from the well. The control unit is operatively connected to the automated production choke to selectively operate the automated production choke to change the volume of sand-bearing hydrocarbon fluids and water released from the well in response to the length of time between successive sand dump sequences.

In a further embodiment, the control unit controls the production choke to further open when the length of time between successive sand dump sequences is greater that a preselected maximum interval stored in the memory.

In a yet further embodiment, the control unit controls the production choke to further close when the length of time between successive sand dump sequences is less that a preselected minimum interval stored in the memory.

In a still further embodiment, while executing a sand dump sequence, the first dump command sent by the control unit commands the automated sand dump choke valve to open to a preselected percentage of full open.

In another embodiment, the first dump command sent by the control unit commands the automated sand dump choke valve to open at a preselected rate to the preselected percentage of full open.

In yet another embodiment, after sending the first dump command, the control unit waits a preselected period of dwell time before sending the final dump command to close the automated sand dump choke valve.

In a still further embodiment, the automated sand dump system further comprises a dump line sensor attached to the sand dump line for sensing a parameter indicative of whether sand or fluid is passing through the sand dump line and producing a parameter signal corresponding thereto. The dump line sensor is operably connected to the control unit to provide the parameter signal to the control unit. The processor compares the parameter signal to a predetermined value stored in the memory to determine if a sand-to-water transition is imminent. When the processor determines that a sand-to-water transition is imminent, the processor sends the final dump command to close the automated sand dump choke valve.

In another aspect, an automated sand dump system is provided for an oil and gas well. The well comprises a production wellhead for routing sand-bearing hydrocarbon fluids and water from the well into a production line. The automated sand dump system comprises a sand trap vessel having an outer wall defining an exterior and an interior cavity, the sand trap vessel further including a production inlet for receiving sand-bearing hydrocarbon fluids and water from a production line into an upper portion of the interior cavity, a production outlet for releasing hydrocarbon fluids and water from the upper portion of the interior cavity, and a sand dump outlet for releasing sand from a lower portion of the interior cavity. An automated sand dump choke valve is operably connected to the sand dump outlet to control the release of sand from the lower portion of the interior cavity by opening to release sand from the lower portion of the sand trap vessel and by closing to prevent the release of sand from the lower portion of the sand trap vessel. A control unit includes a processor, a memory, a communications interface, a display screen and a human-machine interface (HMI), all being operably interconnected to one another. The HMI can be used to input a dump schedule comprising a plurality of dump times and dump durations into the memory of the control unit. The processor evaluates a system time against the plurality of dump times in the dump schedule stored in the memory. When the processor determines that the actual time is equal to a respective one of the dump times in the dump schedule, the processor directs the control unit to execute a sand dump sequence for the respective duration. When executing a sand dump sequence, the control unit sends a first dump command to open the automated sand dump choke valve and subsequently sends a final dump command to close the automated sand dump choke valve.

BRIEF DESCRIPTION OF THE DRAWINGS

For a more complete understanding, reference is now made to the following description taken in conjunction with the accompanying Drawings in which.

DETAILED DESCRIPTION

Figure 1:
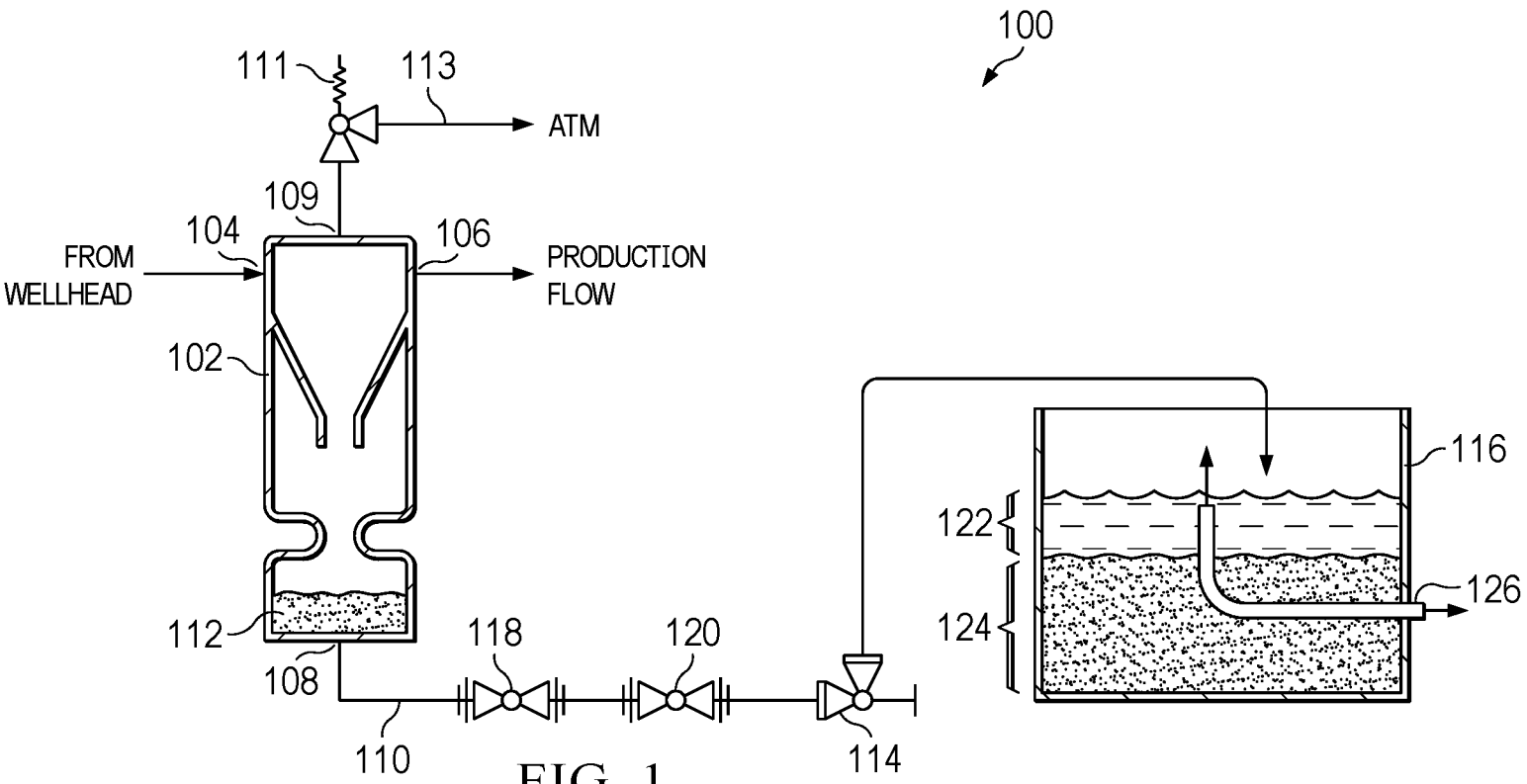
FIG. 1 is a schematic diagram of a sand separation apparatus having a manually operated sand dump system.

Referring now to FIG. 1, there is illustrated a sand separation system 100 having a manually operated sand dump system. System 100 includes a sand trap 102 with production inlet 104, production outlet 106 and sand dump outlet 108. The sand trap 102 can also include a relief outlet 109 connected to a relief line 113 via safety relief valve 111. A sand dump line 110 is connected to the sand dump outlet 108 to receive sand 112 released from the lower portion of the sand trap 102. Flow through the sand dump line 110 is controlled by a manually operated choke valve 114, which allows sand to flow into the sand storage tank 116. A pair of plug valves 118 and 120 are typically provided in the sand dump line 110 upstream of the choke valve 114 to allow isolation of the choke valve during maintenance. Liquids 122 and solids 124 will generally stratify in the sand storage tank 116, thereby allowing the liquids to be drained out using a drain line 126.

Figure 2:
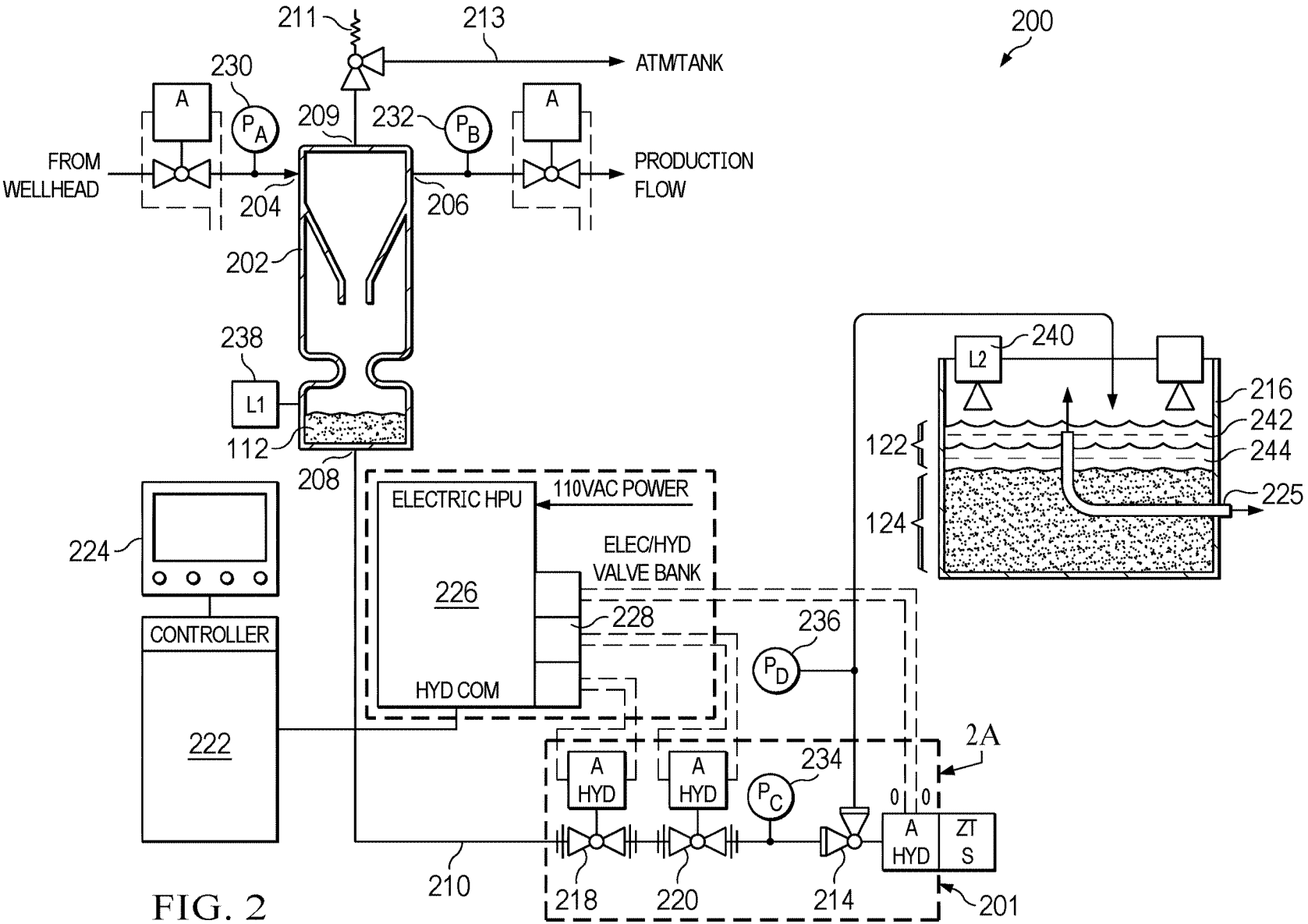
FIG. 2 is a schematic diagram of a sand separation apparatus having an automated sand dump system in accordance with one aspect.
Figure 2A:
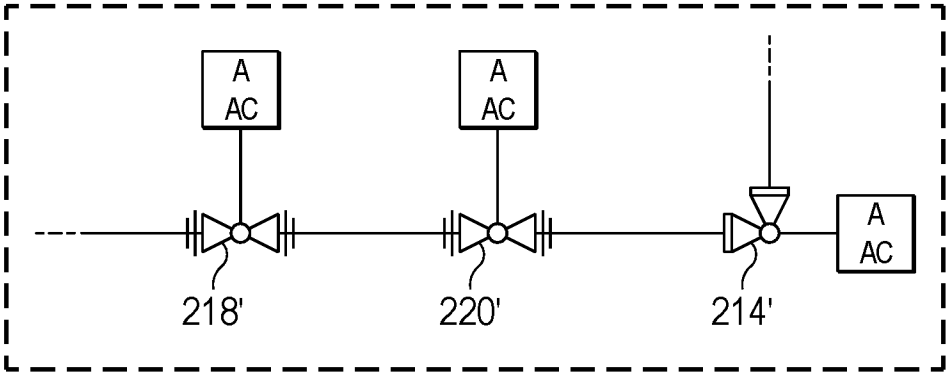
FIG. 2*a* is a partial schematic illustrating an alternative structure for the structure marked "FIG. 2*a*" in FIG. 2.

Referring now to FIG. 2, there is illustrated another sand separation system 200 including an automated sand dump system 201. System 200 includes a sand trap 202 with production inlet 204, production outlet 206, a sand dump outlet 208. The sand trap 202 can also include a relief outlet 209 connected to a relief line 213 via safety relief valve 211. In the illustrated embodiment, the sand trap 202 is a hydrocyclone-type device; however, other embodiments may use other types of particulate separators. Some embodiments of the automated sand dump system 201 include the sand trap vessel 202 as well as the control unit, sensors, valving, etc. described herein, whereas other embodiments do not include the sand trap vessel itself to allow use of the automated sand dump system with existing sand separation systems or with sand traps supplied by the user. A sand dump line 210 is connected to the sand dump outlet 208 to receive sand 112 (and sometimes liquids) released from the lower portion of the sand trap 202. Flow through the sand dump line 210 is controlled by an automated choke valve 214, which allows sand and liquids to flow into the sand storage tank 216. A pair of plug valves 218 and 220 are typically provided in the sand dump line 210 upstream of the automated choke valve 214 to allow isolation of the choke valve during maintenance. In some embodiments, the plug valves 218 and 220 are manual plug valves; however, in the illustrated embodiment, the plug valves 218 and 220 are automated. The automated choke valve 214 and the automated plug valves 218, 220 of the illustrated embodiment are hydraulically actuated; however, in alternative embodiments (e.g., shown in FIG. 2*a*) the automated choke valve and the automated plug valves can be electrically actuated, e.g., by AC or DC electrical power. Liquids 122 in the sand storage tank 216 will generally stratify into oil 242 and water 244 above the solids 124 (which is mostly sand 112), thereby allowing the liquids to be drained individually or collectively using one or more drain lines 225.

The automated sand dump system 201 further includes a control unit 222 that is operably connected to the sensors (e.g., sensors 230, 232, 234, 236, 238 and 240 supplying pressures $P_A$, $P_B$, $P_C$, $P_D$ and levels L1 and L2 respectively) and actuators (e.g., on the automated choke valve 214 for transmitting control commands and position information ZT5 and on the automated plug valves 218 and 220 for transmitting control commands and position information) of the automated sand dump system. The connections between the control unit 222 and the individual sensors and actuators can be hydraulic, electrical, and/or wireless; therefore the individual connection may not be illustrated. The automated sand dump system 201 further includes a control unit 222 having a human machine interface (HMI) 224. The control unit 222 can further include a processor, a memory and a communications interface operably interconnected to one another, e.g, via a communication bus (see FIG. 3). The HMI 224 includes one or more display devices for providing information to the user and one or more input devices for receiving inputs from the user. In some embodiments, the HMI 224 can be a single device, e.g., a touch screen, whereas in other embodiments the HMI can comprise separate display screens, a keyboard, a joystick, buttons, switches, etc.

In the illustrated embodiment, the control unit 222 is operably connected to a hydraulic power unit (HPU) 226 operating on 110 VAC power. The HPU 226 include an electro-hydraulic valve bank 228 that routes hydraulic fluid at the command of the control unit 222 to the appropriate actuator for controlling the automated choke valve 214 and/or the automated plug valves 218, 220. In the alternative embodiment of FIG. 2*a*, the automated choke valve 214' and automated plug valves 218' and 220' are electrically actuated, therefore the HPU 226 may not be required.

In some embodiments, the automated sand dump system 201 can operate on a scheduled dump basis. This is further described in detail herein but described in brief here. The HMI 224 can be used to input a dump schedule comprising a plurality of dump times and dump durations into the memory of the control unit 222. The control unit 222 evaluates a system time (e.g., actual time) against the plurality of dump times in the dump schedule stored in the memory. When the control unit 222 determines that the system time is equal to a respective one of the dump times in the dump schedule, the control unit executes a sand dump sequence for the respective duration. When executing a sand dump sequence, the control unit 222 sends a first dump command to open the automated sand dump choke valve 214 and subsequently sends a final dump command to close the automated sand dump choke valve. The control unit then monitors the dump schedule until the next dump time arrives.

In some embodiments, the automated sand dump system 201 can operate on a dynamic sensing basis, wherein the system monitors sensed system values in real time to detect conditions indicating that a sand dump is needed, whereupon a sand dump sequence is executed. To provide dynamic sensing capabilities, the automated sand dump system 201 further includes one or more sensors attached to the various lines and vessels of the sand separation system 200 to measure conditions necessary for the control of sand dumping, well production and/or sand storage. In the embodiment of FIG. 2, the automated sand dump system 201 includes pressure sensors as follows: a inlet pressure sensor 230 on the production inlet line to measure the inlet pressure ($P_A$) to the sand trap 202, an outlet pressure sensor 232 on the production outlet line to measure the outlet pressure ($P_B$) from the production outlet of the sand trap, a sand dump outlet pressure sensor 234 on the sand dump line to measure the pressure ($P_C$) in the sand dump line upstream of the automated choke valve 214 and a dump line pressure sensor 236 on the sand dump line to measure the pressure ($P_D$) in the sand dump line downstream of the automated choke valve. In the embodiment of FIG. 2, the automated sand dump system 201 includes level sensors as follows: a sand trap level sensor 238 on the sand trap 202 for measuring the sand level (L1) of sand 112 in the sand trap and a sand tank level sensor 240 on the sand storage tank 216 for measuring the sand level (L2) in the sand storage tank.

The sensors 230, 232, 234, 236, 238 and 240 are operably connected to the control unit 222 to send respective sensor signals to the control unit. The control unit 222 evaluates the respective sensor signals to produce respective reported values and compares one or more of the reported vales to one or more predetermined values stored in the memory of the control unit. In some operations, the comparison of reported values to predetermined values can be used by the control unit 222 to determine an effective sand level in the sand trap 202. In other operations, the comparison of reported values to predetermined values can be used by the control unit 222 to determine the condition of a choke valve or plug valve for maintenance purposes.

The effective sand level determined by the control unit 222 may be an actual (i.e., quantitative) level of the sand 112 inside the sand trap 202 or it may be a qualitative level at which the performance of the sand trap 202 is considered unacceptable (e.g., due to excessive sand presence in the production outlet). When the control unit 222 determines that the effective sand level has exceeded a predetermined sand level stored in the memory, the control unit can execute a sand dump sequence. During the sand dump sequence, the control unit 222 sends a first dump command to open the automated sand dump choke valve 214 and subsequently sends a final dump command to close the sand dump choke valve. The first dump command of the control unit 222 can specify various parameters for opening the automated sand dump choke valve 214, including, but not limited to: the desired open position as a percentage of full open; the rate at which the choke valve is opened; and/or the time duration for opening the choke valve to the desired open position. Similarly, the final dump command of the control unit 222 can specify various parameters for closing the automated sand dump choke valve 214, including, but not limited to: the rate at which the choke valve is closed; and/or the time duration for closing the choke valve from the initial open position.

In one embodiment, the automated sand dump system 201 of FIG. 2 can use a change in the sensed differential pressure ($\Delta P$) between the pressure $P_A$ at the production inlet 204 and the pressure $P_B$ at the production outlet 206 to determine the effective sand level in the sand trap 202. For example, in a hydrocyclone-type sand trap, low levels of sand within the sand trap result in the highest $\Delta P$ between the production inlet 204 and the production outlet 206 (assuming inlet pressure, flow rate and flow materials remain constant). As the level of sand increases in the sand trap 202, the hydrocyclone will eventually plug off, at which time the $\Delta P$ measurably decreases. Upon detecting the decrease of $\Delta P$ indicating the hydrocyclone has plugged off, the control unit 222 can determine the effective sand level is high enough to execute a dump sequence and release sand from the sand trap.

In another embodiment, the automated sand dump system 201 of FIG. 2 can use a direct measurement of the sand level in the sand trap 202 using the sand trap level sensor 238. The sand trap level sensor 238 may use sensor technologies including, but not limited to, ultrasonic, acoustic, magnet and nuclear source to sense the level of sand 112 within the sand trap 202. When the sand trap level sensor sends a signal to the control unit 222 indicative that the sand level has reached a predetermined level, the control unit can execute a dump sequence.

In a still further embodiment, the automated sand dump system further comprises a dump line sensor attached to the sand dump line for sensing a parameter indicative of whether sand or fluid is passing through the sand dump line and producing a parameter signal corresponding thereto. The dump line sensor is operably connected to the control unit to provide the parameter signal to the control unit. The processor compares the parameter signal to a predetermined value stored in the memory to determine if a sand-to-water transition is imminent. When the processor determines that a sand-to-water transition is imminent, the processor sends the final dump command to close the automated sand dump choke valve.

In some embodiments, the automated sand dump system 201 can open and close the automated plug valves 218 and 220 and/or automated choke valve 214 in a predetermined sequence to detect maintenance issues such as wear on the choke valve or leaking of the plug valves.

Figure 3:
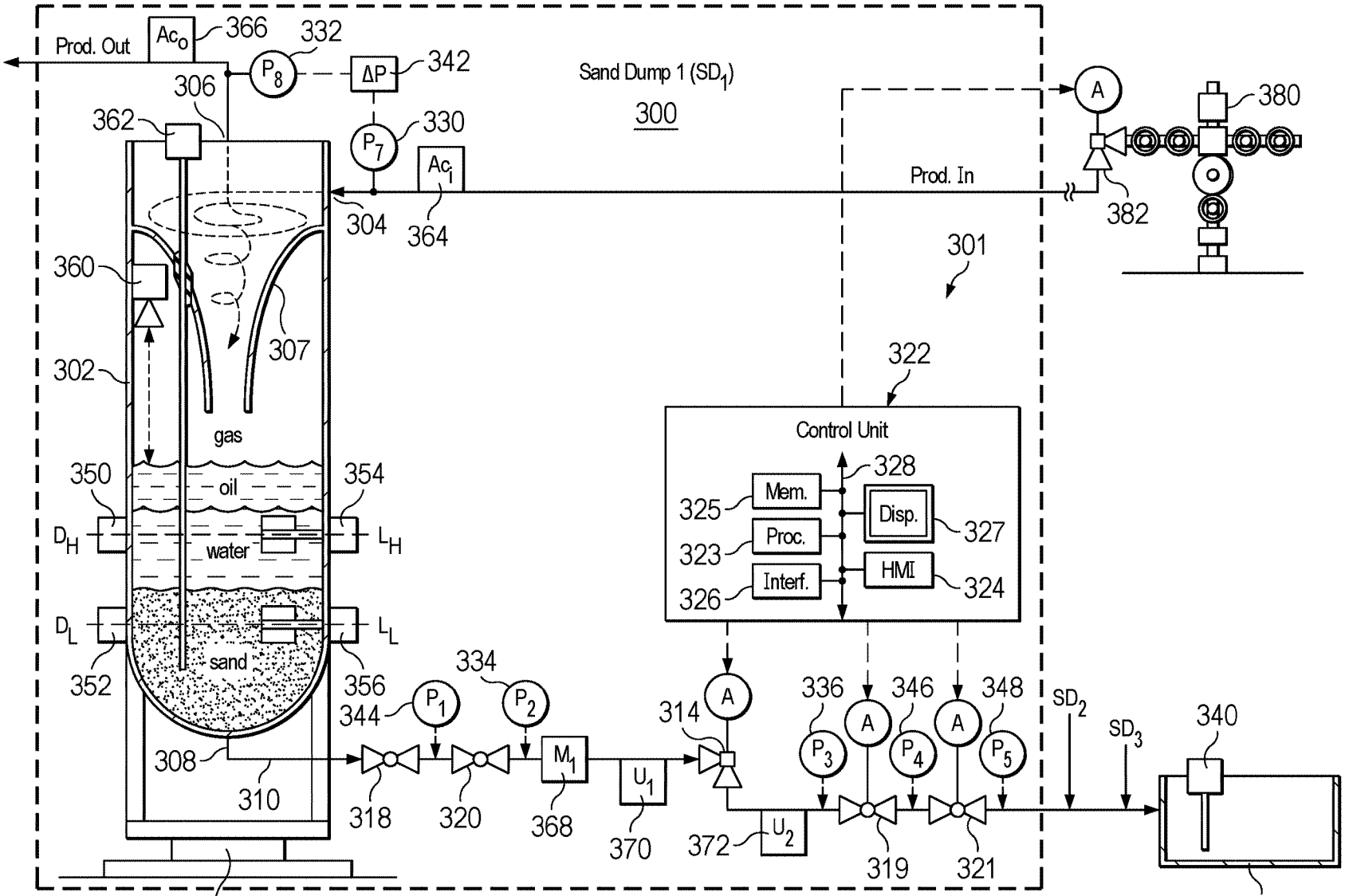
FIG. 3 illustrates a sand dump module of a sand separation system having an automated sand dump system is accordance with additional aspects.

Referring now to FIG. 3, there is illustrated another sand separation system 300 showing further details of an automated sand dump system 301. System 300 includes a sand trap 302 with production inlet 304, production outlet 306 and sand dump outlet 308. In the illustrated embodiment, the sand trap 302 is a hydrocyclone-type device including an internal baffle 307; however, other embodiments may use other types of particulate separators. Some embodiments of the automated sand dump system 301 include the sand trap vessel 302 as well as the control unit, sensors, valving, etc. described herein, whereas other embodiments do not include the sand trap vessel itself to allow use of the automated sand dump system with existing sand separation systems or with sand traps supplied by the user. A sand dump line 310 is connected to the sand dump outlet 308 to receive sand 112 (and sometimes liquids) released from the lower portion of the sand trap 302. Flow through the sand dump line 310 is controlled by an automated choke valve 314, which allows sand and liquids to flow into the sand storage tank 316. A first pair of plug valves 318 and 320 are typically provided in the sand dump line 310 upstream of the automated choke valve 314 to allow isolation of the choke valve during maintenance. In the illustrated embodiment a second pair of plug valves 319 and 321 are also provided in the sand dump line 310 downstream of the automated choke valve 314 to allow automated diagnosis of leakage in through the automated choke valve 314 and/or the isolation plug valves 318 and 320.

The automated sand dump system 301 further includes a control unit 322 that is operably connected to the sensors and actuators (i.e., on the automated choke valve and plug valves) of the automated sand dump system. The connections between the control unit 322 and the individual sensors and actuators can be hydraulic, electrical, and/or wireless; therefore the individual connection may not be illustrated. The control unit 322 includes include a processor 323, a memory 325, a communications interface 326, a HMI 324 and a display device 327 that are operably interconnected to one another, e.g, via a communication bus 328. The HMI 324 can include one or more display devices for providing information to the user and one or more input devices for receiving inputs from the user. In some embodiments, the HMI 324 can be a single device, e.g., a touch screen, whereas in other embodiments the HMI can comprise separate display screens 327, a keyboard, a joystick, buttons, switches, etc.

In some embodiments, the automated sand dump system 301 can operate on a dynamic sensing basis as previously described. To provide dynamic sensing capabilities, the automated sand dump system 301 further includes one or more sensors attached to the various lines and vessels of the sand separation system 300 to measure conditions necessary for the control of sand dumping, well production and/or sand storage. In the embodiment of FIG. 3, the automated sand dump system 301 includes pressure sensors as follows: an inlet pressure sensor 330 on the production inlet line 304 to measure the inlet pressure (P7), an outlet pressure sensor 332 on the production outlet line 306 to measure the outlet pressure (P8) from the production outlet of the sand trap, a sand dump outlet pressure sensor 334 on the sand dump line 310 to measure the pressure (P2) in the sand dump line upstream of the automated choke valve 314 and a dump line pressure sensor 336 on the sand dump line to measure the pressure (P3) in the sand dump line downstream of the automated choke valve. In the embodiment of FIG. 3, the system 301 further includes pressure sensors as follows: a differential pressure sensor 342 between the inlet pressure sensor 330 and the outlet pressure sensor 332 (or between the production inlet 304 and the production outlet 306) to directly measure the ΔP between P7 and P8, a first diagnostic pressure sensor 344 on the sand dump line 310 to measure the pressure (P1) between plug valves 318 and 320, a second diagnostic pressure sensor 346 on the sand dump line to measure the pressure (P4) between plug valves 319 and 321 and a third diagnostic pressure sensor 348 on the sand dump line to measure the pressure (P5) downstream of the plug valve 321.

In the embodiment of FIG. 3, the automated sand dump system 301 can include sand level sensors including, but not limited to: a densitometer high level sensor 350 ($D_H$), a densitometer low lever sensor 352 (DL), a resistive paddle high level sensor 354 ($L_H$), a resistive paddle low level sensor 356, a sand trap mass/weight sensor 358, an internal sand level direct sensor (radar or ultrasonic) 360, internal fiber optic level sensor 362, a first acoustic noise level sensor 364 ($AC_I$) on the production inlet 304, a second acoustic noise level sensor 366 ($AC_O$) on the production outlet.

The sand dump system 301 can include dump line sensors for detecting an imminent sand to water transition including, but not limited to: a magnetic sensor 368 ($M_1$) and a first ultrasonic or acoustic sensor 370 ($U_1$) located upstream of the automated choke valve 314, a second ultrasonic or acoustic sensor 372 ($U_2$) located downstream of the automated choke valve. The system 301 can further include a sand tank level sensor 340 on the sand storage tank 316 for measuring the sand level in the sand storage tank.

In some embodiments, the wellhead 380 will include an automated production choke valve 382 for controlling the volume of sand-bearing hydrocarbon fluids and water delivered into the production input line 304. The control unit 322 of the automated sand dump system 301 can be operatively connected to the automated production choke valve 382 to selectively operate the automated production choke valve to change the volume of sand-bearing hydrocarbon fluids and water released from the well in response to the length of time between successive sand dump sequences. When the dump sequences are spaced too close together (i.e., time between dump sequences reaches a preset minimum value), the system 301 can command the production choke valve 382 to incrementally close to reduce the amount of sand being received. When the dump sequences are spaced too far apart (i.e., time between dump sequences reaches a preset maximum value), the system 301 can command the production choke valve 382 to incrementally open to increase the amount of hydrocarbons being produced.

System Power

The system will be powered by any combination of local electrical power supply, a diesel/gas generator or more uniquely a hybrid wind, solar & battery power generation system. Semtive is an example of such a new hybrid system that we plan to incorporate. This is important as there is typically not an available power supply at many of the remote well sites. Also to provide and run a gas/diesel powered generator requires significant time, cost and attention to keep it running and this defeats the purpose of the automated and autonomous system System Health, Operational Data and Control In some embodiments, the system can monitor its own health and data and report out locally and remotely via normal wireless and internet to applications for users.

In some embodiments, the system can have data communications to allow for remote monitoring, control, reporting and alerts.

This monitoring capability may include advanced analytics and AI to specifically identify what is going wrong and make decision to limit or shut down the system and alert on what the problem is.

In some embodiments, the system can monitor the sand dump waste storage tank 116, 216, 316 for both fullness, levels of sand, water and hydrocarbons and also gases that escape the trap when dumping (unloading).

Monitoring of the Health of the Valves in the Automated Sand Dump System

Pressure sensors (e.g., diagnostic pressure sensors 344, 346, 348) can be used to check for leakage in any of the automated valves (e.g., automated valves 218, 220, 319, 221) and the choke (e.g., chokes 214, 314). Various methods can be used to sequence the valves while monitoring pressure on the diagnostic pressure sensors to determine if any valves are potentially leaking or having actuation problems. The system can monitor dumping pressures and can also periodically run open and close test sequences to learn and determine if valves are starting to leak.

In some embodiments, when the system detects leakage or mechanical operation problems with system components, the system can reconfigure itself into a safe state and alert users to the detected issues so the system can be inspected and repaired. This can be a local alert system and/or a remote alert system.

As illustrated in FIG. 3, there are novel benefits to having the two automated block and bleed valves 319, 321 after (i.e., downstream of) the choke 314 controlling the dump, although in other embodiments the block valves can be positioned before the choke if customer requests.

Benefits to the arrangement of the system 300 with automated block valves 319, 321 positioned downstream of the choke 314 as illustrated in FIG. 3 are such that they experience less wear as they can be fully open prior to receiving flow from the system as the choke can hold the flow back until they are fully opened. Also, the valves 319, 321 can experience less wear on closing as the choke 314 closes first and then the valves 319, 321 close in an unpressured stable environment versus being up stream of the choke on the pressurized side of the system.

In some embodiments, the system 200, 300 can monitor dump flows to detect when a dump valve (e.g., valves 218, 220, 319, 321) or choke (e.g., chokes 214, 314) is plugged, which can be detected by a no flow condition or a flow volume being smaller than expected on the dump line 310. When a plugged dump valve or choke is detected, the system 200, 300 can automatically cycle the dump valves and/or chokes (i.e., between full closed to full open) to clear the plug. The system 200, 300 need not determine which specific dump valve or choke is plugged to initiate the valve/choke plug clearing cycle. When the system 200, 300 detects the valve/choke plug clearing cycle was unsuccessful (i.e., plugged conditions still exist), in some embodiments the system can initiate a predetermined number of successive valve/choke plug clearing cycles. In some embodiments, when the system 200, 300 detects the valve/choke plug clearing cycle was unsuccessful (or was unsuccessful after the predetermined number of successive cycles), the system can close all valves/chokes and issue an alert of the issue. In some embodiments of the system 200, 300, when a plugged valve or choke is detected, the system can close the automated production choke valve 382 to shut in the wellhead 380 to prevent sand from overflowing the sand trap 302 and damaging downstream equipment.

System Sensoring and Controls

Well

In some embodiments, the system 200, 300 can monitor production flows and pressures on the production inlet 204, 304 (e.g., using pressure sensor 230, 330) when dumping so as not to surge and damage the producing well 380. When the system 200, 300 detects surging of the well 380, the system can close the automated production choke valve 382 to reduce the flow from the wellhead until the surging stops.

Dump Line

In some embodiments, the system 300 can monitor the output line 310 or valve output line in the dump system acoustically to determine whether the material flowing is primarily sand, water, oil or gas.

In some embodiments, the system 300 can monitor the output line 310 or valve output line in the dump system using magnetic sensors 368, ultrasonic sensors 370, 372 or vibration sensors that clamp on to the external surface of the pipe.

In some embodiments, the output of ultrasonic sensors 370, 372 or vibration sensors is used to "listen" to the flow of the sand, water, oil and gas through the choke and pipework at any given time. The sound spectrum produced is different for each medium (i.e., sand, water, oil and gas) flowing at a given pressure and flow rate, and the various sound spectrums can be recorded or modelled and stored in the system 200, 300. The system can then compare the current sound spectrum detected by the sensors 370, 372 to the various modeled/stored sound spectrums to detect which medium is currently flowing in the dump line 310. When the currently flowing media detected from the output of ultrasonic sensors 370, 372 or vibration sensors matches predetermined conditions (e.g., representing oil or gas in the dump line) the system can close the output valve or choke, e.g., choke 214, 314, to reduce or stop the dump flow.

In some embodiments, the output of state of the art ultrasonic sensors (such as made by Salunda) can be used to monitor the flow of the sand, water, oil and gas through the choke and pipework. The output is different for each medium flowing at any given time and this can be modelled and used to close the output valve or choke at the appropriate time.

In some embodiments, the output of the latest HP magnetic in line sensors (such as manufactured by TECO) can be used to determine if a conductive or non-conductive fluid is in the dump line 310. Enabling the output valve or choke 214, 314 to close when the fluid flow transitions from sand and water to oil or gas.

In other embodiments, nuclear source sensors can be used to detect the material flowing in the dump line 310, but this is typically unviable as such sources cannot be left alone in vulnerable remote locations where they are subject to theft by bad actors.

These various output line sensors may be used to support controls as to when to stop dumping, or when to throttle the dumping into the dump line 310. Dumping the sand and water is needed, but dumping as little oil and gas as possible is also desired.

Sand Trap

Sensors On Sand Trap To Automate Sand Dumping

The system 200, 300 may monitor the levels of different sand, fluids and gases in the sand trap 202, 302 using the sensors described herein.

Ultrasonic Sensors

In some embodiments, ultrasonic sensors can be used to monitor through the steel of the sand trap 202, 302 to determine if gas, water, sand is in the tank.

In some embodiments, the level of medium in the tank 202, 302 (differentiate between gas, water/oil, slurry and mostly sand/water) can be measured using sensors including, but not limited to: guided radar (i.e., level sensors); magnetic flow sensors (i.e., flow rate and material type sensor); and nuclear radiation sensors (i.e., density sensors).

In some embodiments, the system 200, 300 can determine the level of the gas, oil, water or sand inside the steel sand trap 202, 302. Determine the density of the media flowing through the pipework. The determination may be done at different height in the sand trap 202, 302 to support controls in when to start and stop dumping.

The output from these sensors may be used to support controls as to when to start and stop dumping. Dumping the sand and water, but as little oil and gas as possible. The system 300 can use a sensor 358 to weigh the sand capture equipment 302 and understand the level of fullness of the system and when it needs to be emptied (dumped). For example, load pins and/or weight cell 358 can be used.

The system 300 can use the delta pressure ($\Delta P$) across the sand trap input and output production lines 304, 306 to support control of when to start or stop dumping.

The system 300 can use a proximity sensor with floating ring assembly inside the HP sand trap 302 to determine the level of liquids within.

The system 300 can determine the height of the fluids inside the sand trap 302. For example, the system can use proximity sensing tech to determine High & Low (i.e., possibly HH, H, L & LL) of the fluids in tank.

The system 300 can use resistive paddle sensors 354, 356 to determine the level of different mediums within the sand trap 302. Resistive paddle sensors 354, 356 use internal paddles that rotate with torque that changes depending on medium it is in. This is similar to a viscosimeter in operation. The resistive paddle sensors rotate easily requiring low torque in gas, require medium torque in water, and can stall out or require high torque in sand.

The sensors on the sand trap 302 can be used to determine when to open the dump valve 314 and discharge the tank contents into the dump line 310 and when to stop discharge before complete fluid discharge to prevent discharge of wellbore gases to the atmosphere Sand Trap Dump—Dump Cycle Time Learning Method The system 200, 300 can monitor the time between dumps and what was dumped to determine ahead of time how long until the next optimal dump cycle and to estimate how long the dump cycle might take.

The system 200, 300 can use sensor data and historical data to determine this.

The system 200, 300 can utilize a time to dump as an estimate (i.e., proxy) of how much volume was dumped from the sand trap 302, incorporating valve/choke position and pressure into the calculation.

When the system 200, 300 determines that too much dump time (or too much dump volume) was required to dump the sand (i.e., to a predetermined level, or until showing gas), the system can reduce the cycle time between dumps to prevent the trap from overfilling and not trapping sand as it should.

When the system 200, 300 determines that too little dump time (or too little dump volume) was dumped before getting gas, the system can increase the cycle time between dumps to ensure there is enough time for the trap to fill and to reduce the danger that the dump valve will not open and close fast enough. Also it wastes energy and wears all the valves opening and closing too often.

Utilizing knowledge of the content of the sand trap 202, 302 the system 200, 300 can controllably open and close the dump line valve 214, 314 to allow just sand and water or sand, water and oil to be dumped.

The system 200, 300 automatedly dumps the sand trap 202, 302 before the device is full and no longer capturing the sand in the flow.

The system 200, 300 can also be put on a preprogrammed schedule as to when to sump sand and content of sand trap and for how long.

The system 200, 300 can be configured to only dump sand while maintaining a predetermined minimum pressure at the wellhead 380 and/or system pressure.

There are several potential different methods of sensoring and modelling the sand trap 202, 302 to support automation of the discharge sequence while preventing overfilling of the tank and preventing gas discharge from the dump line, utilizing combination of the methods above.

Dump Valve Preference

Historically the valves used to dump the sand traps 102 have been of simple manual needle and seat type These wear at a great rate in this service and need regular maintenance In some embodiments, the system 200, 300 uses an automated linear gate and seat type choke valve 214, 314 such as the Power Choke SCB2 choke produced by Power Chokes. These electrically or hydraulically actuated valves, can open and close in a few seconds limiting the erosion on the gate, seat and body cavity. Such choke valves are also historically known for their erosion resistance and low maintenance requirements in such severe service environments. This type system far outperforms other manual and slower actuated valves and lasts longer between maintenance cycles due to its fast linear operating gate and seat design.

Summary of Additional Data Inputs to Control and Monitoring System

Figure 4:
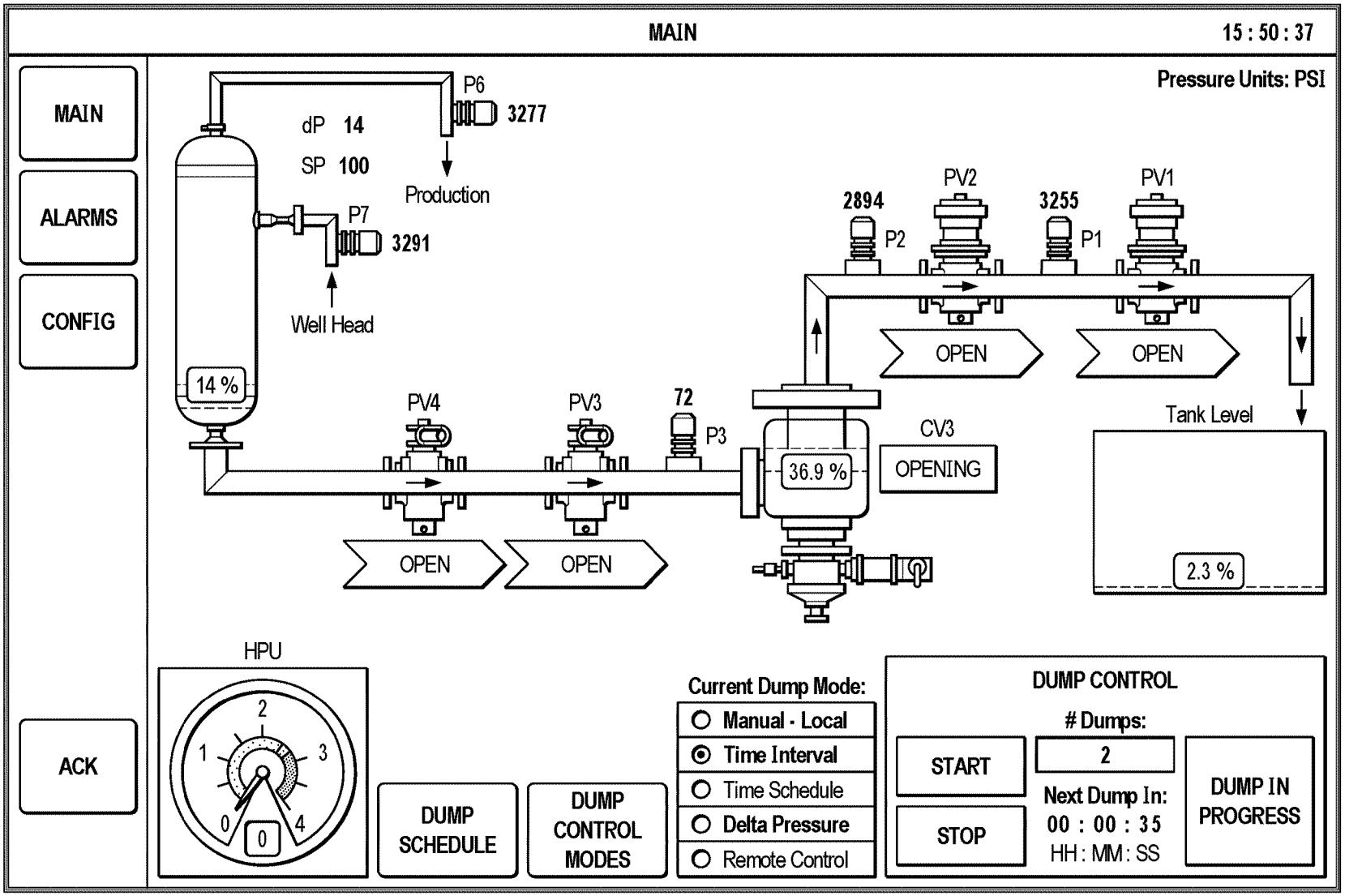
FIG. 4 illustrates a main display screen of a control unit for operating an automated sand dump system in accordance with a further aspect.
Figure 5:
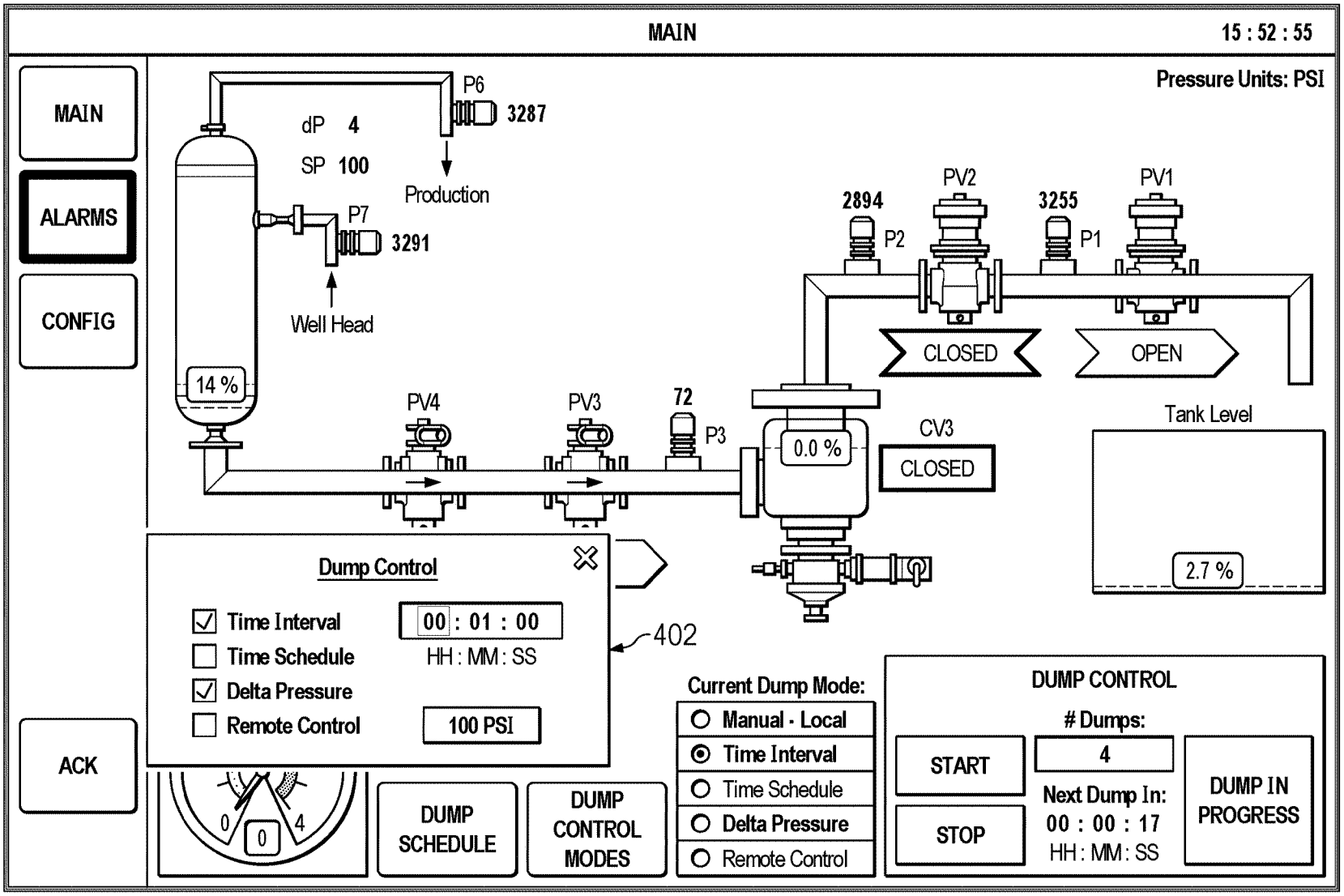
FIG. 5 illustrates the display screen of FIG. 4 with a pop-up window for viewing and changing dump control settings in accordance with another aspect.

System Monitors and Logs
- Well head pressures
- Well 3 or 4 phase Flow—Rate and mix
- Production choke(s) position
- Sand Dump valve and choke positions Sand production estimation from well via sensors
- Sand level in Sand Separators
- System pressures and limits
- Sand Trap Downstream Pressure System Controls
- Production Choke(s)
- Sand Dump Choke(s) and valve manifold
- Maintains minimum system pressures & flow rates
- Shuts down to safe state in event of failure to out of tollerance event System Alarms
- Plugged Chokes
- Lost signal to any device
- Gas or fluid Flow exceeds or goes below flow alarms
- Pressure exceeds or goes below pressure alarms Tank level too high
ESD is triggered
Failed Valve, actuator or sensor
System Limits
Min & Max flow prates
Min & Max Pressures
Max Sand load/weight
Pressure Relief Valve (PRV)/Emergency Shut Down (ESD)
PRV—A Pressure relief system maybe be incorporated to bypass the Sand Trap if plugged, to all production flow to go to a secondary sand trap system
ESD—Emergency shut down methods must be incorporated to ensure the system always assumes a safe state Referring now to FIGS. 4-10, there are illustrated sample displays from the HMI 224, 324 of the control unit 222, 322 of embodiments of the automated sand dump system 200, 300. FIGS. 4-5 illustrated sample screens from a first embodiment of the system. FIGS. 6-10 illustrate sample screens from an alternative embodiment of the sand dump system.

Referring first to FIG. 4, there is shown the main control screen of the HMI 224 for the system 200. The control screen 400 depicts the major components of the system 200 and indicates the status of the dump valves (i.e., "OPEN" or "CLOSED"), the status (i.e., "OPENING") and percentage open of the choke valve (i.e., "36.9%"), the sand trap percentage full (i.e., "14%"), the tank level percentage full (i.e., "2.3%"), and the pressures at various points of the system (i.e., shown in psi). The main control screen 400 further includes a dump control window including stop/start buttons and status indicator, and selector buttons to open pop-up windows for "dump schedule" and "dump control modes."

Referring now to FIG. 5, the main control screen 400 is illustrated after activation of the "dump control mode" pop-up window, which is shown in the lower left portion of the screen. The "dump control mode" pop-up window allows the user to configure the system 200 based on time interval mode, time schedule mode, delta pressure mode and/or remote control mode, and further allows the setting of values for the time interval and the delta pressure.

Figure 6:
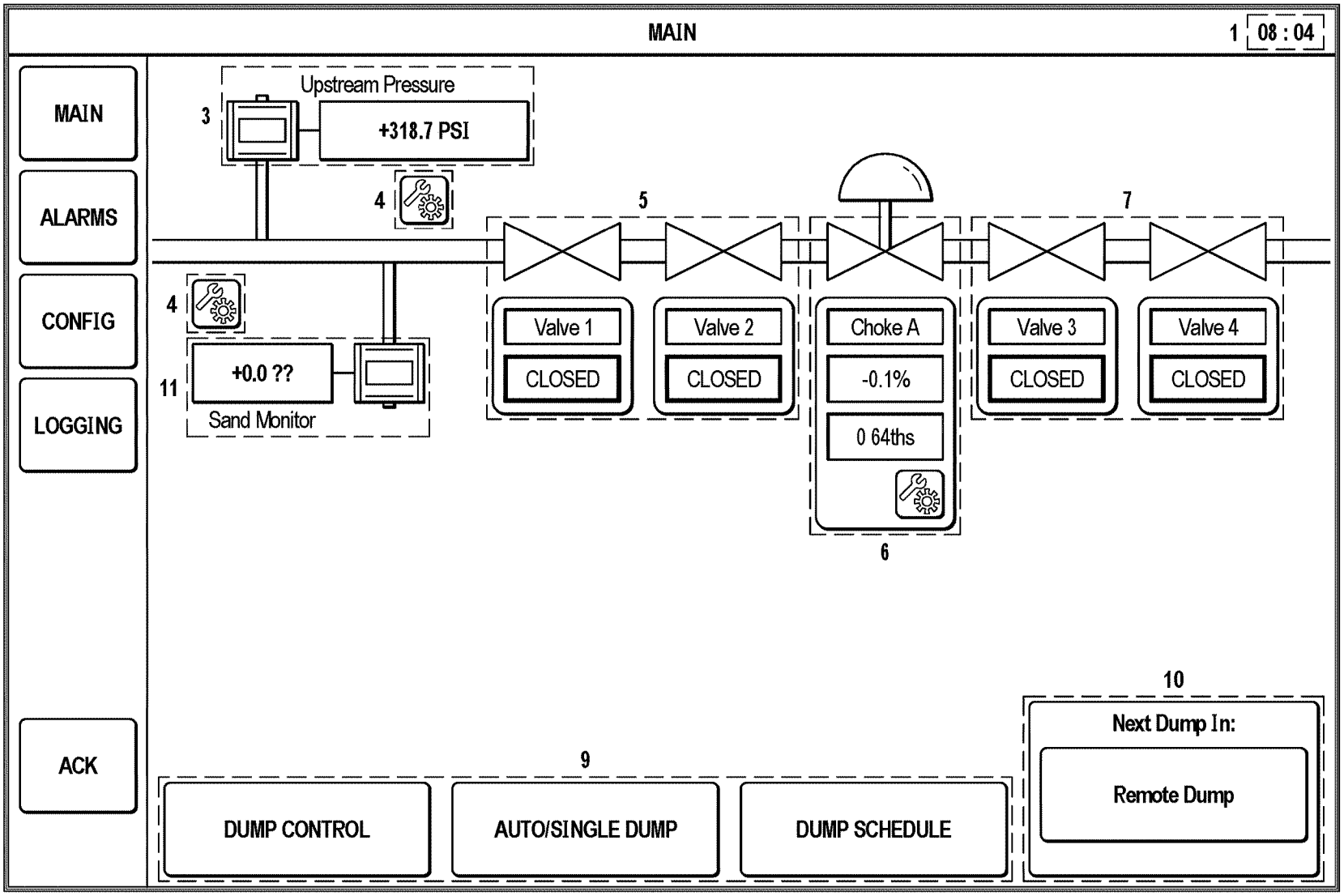
FIG. 6 illustrates a main display screen for a control unit of an alternative sand dump system in accordance with a yet another aspect.

Referring now to FIG. 6, a main display screen 600 of the HMI 324 of a control unit 322 for operating an automated sand dump system 300 is illustrated in accordance with another embodiment. The main display screen 600 includes the following information displays and controls:

1. The current time (denoted "1").
2. Navigation to other screens.
3. The pressure upstream of the choke (denoted "3").
4. Calibration buttons (denoted "4").
5. Upstream valves with current position (denoted "5") displaying mode and status. When not in auto mode can be opened or closed by touch screen.
6. Choke valve with current position in % open and 64ths (denoted "6"). When not in auto mode can be opened or closed by touch screen.
7. Downstream valves with current position (denoted "7"). When not in auto mode can be opened or closed by touch screen.
8. Acknowledge for alarms (denoted "8"; see FIG. 7).
9. Navigation to set dumping options (denoted "9").
10. Countdown to next dump (denoted "10"). Will flash when time is close to dump.
11. (Optional) If using a sand monitor to decide on dumping frequency this is display of the current sand level (denoted "11").

Figure 7:
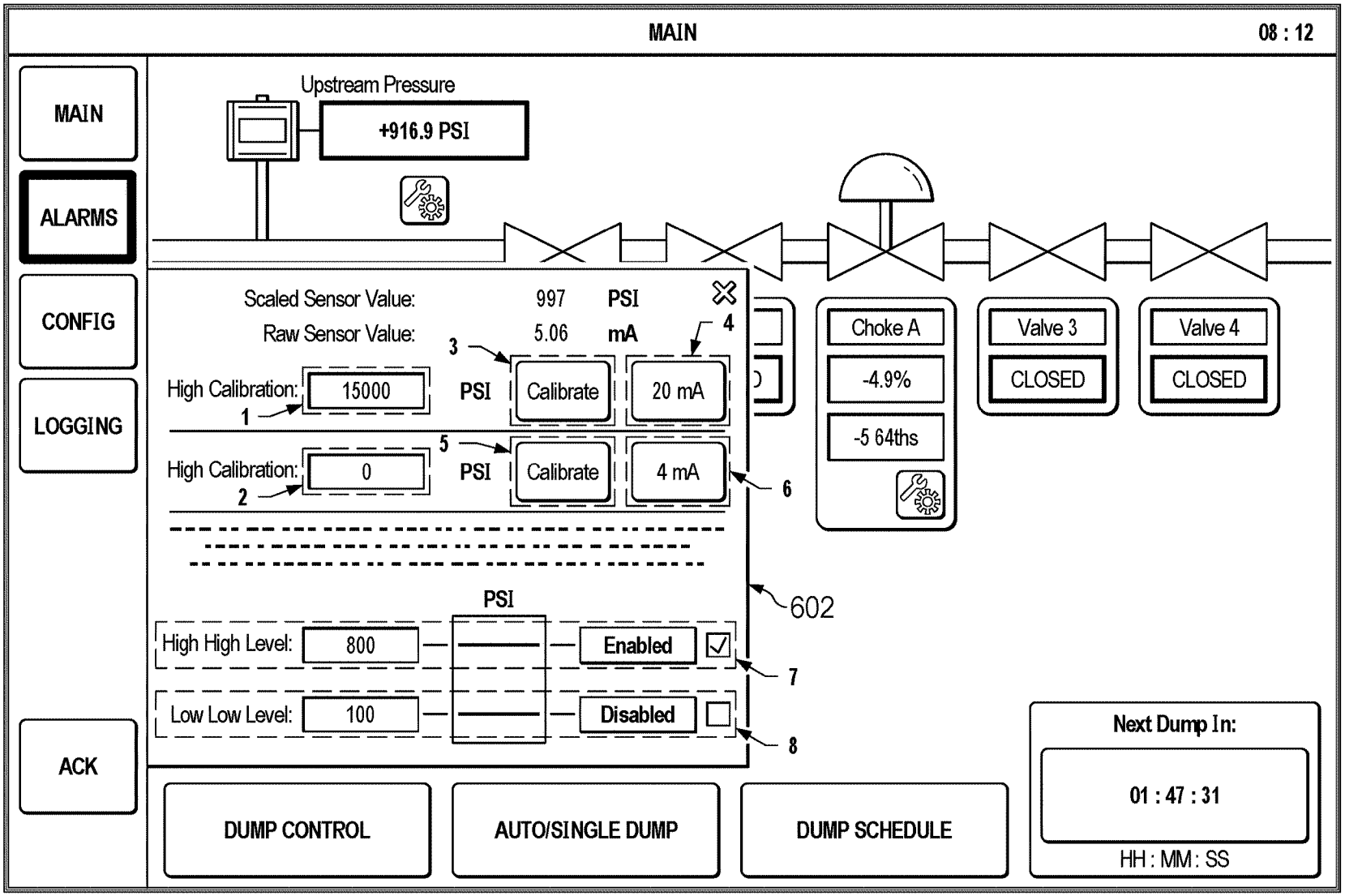
FIG. 7 illustrates the display screen of FIG. 6 with a pop-up window for calibrating sensors of the sand dump system in accordance with another yet another aspect.

Referring now to FIG. 7, there is illustrated the display screen 600 of the control unit with a pop-up window 602 opened in the lower left portion of the screen for selecting a dump mode. The pop-up window 602 includes the following information displays and controls:

1. This is the time between sand dumps (denoted "1"). This will repeat on this time scale until it is placed out of this mode. For example: tapping the box and inserting "02:17" would set up a dump for 2 hours and 17 minutes. Then after this dump another dump for 2 hours and 17 minutes and would repeat this process until the system is taken out of Auto dump mode.
2. Single dump mode (denoted "2") can set up a count down and only dump one time.
3. Auto/Single Dump (denoted "3") can take the user to another pop-up screen to set the options.

Figure 8:
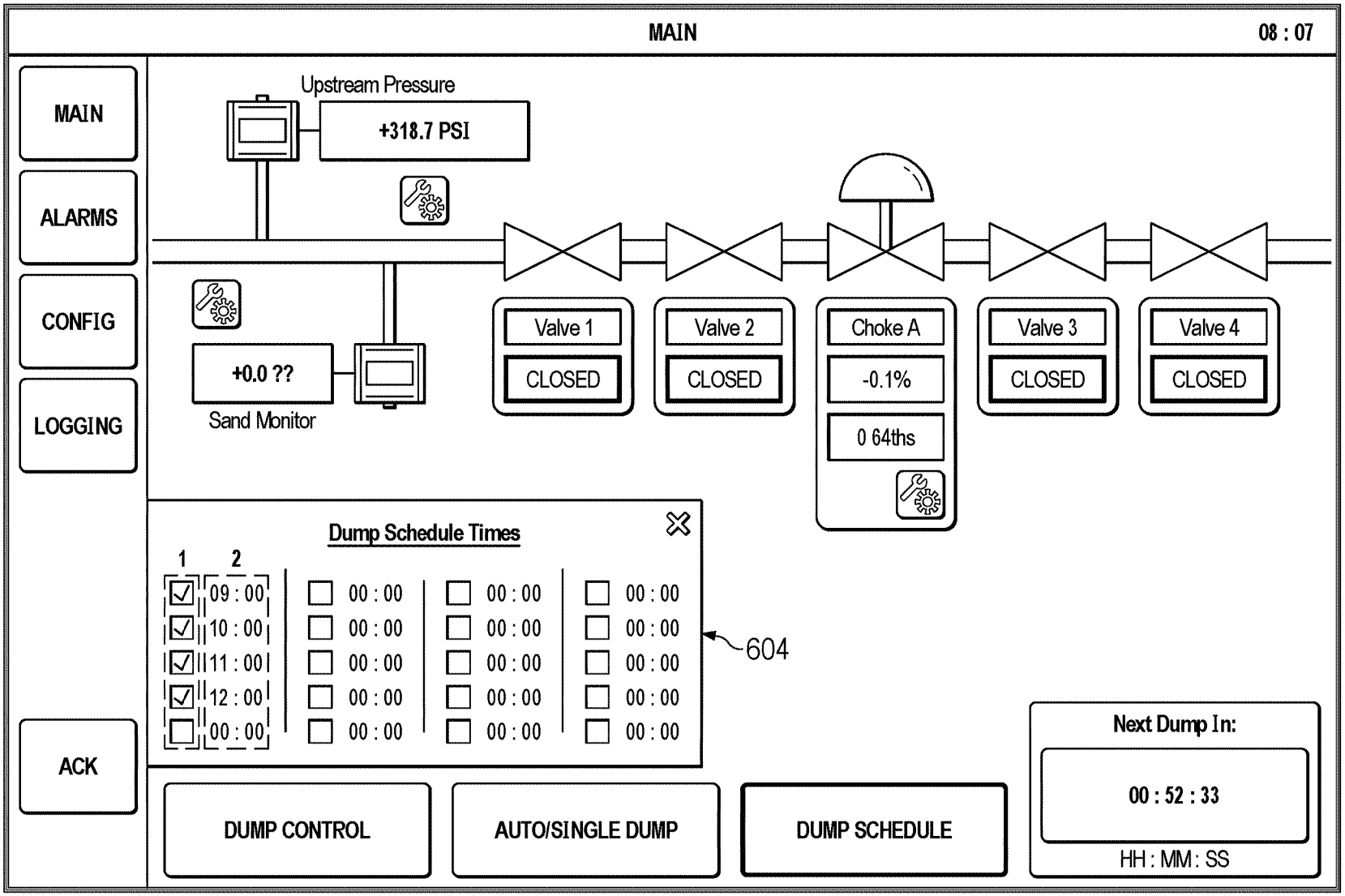
FIG. 8 illustrates the display screen of FIG. 6 with another pop-up window for viewing and changing dump schedule times in accordance with a still further aspect.

Referring now to FIG. 8, there is illustrated the display screen 600 of the control unit with another pop-up window 604 for scheduling dump times. The pop-up window 604 includes the following information displays and controls:

1. Enables or disables the time for a dump to be scheduled (denoted "2").
2. In the illustrated embodiment, time is entered in 24 hr mode.

Figure 9:
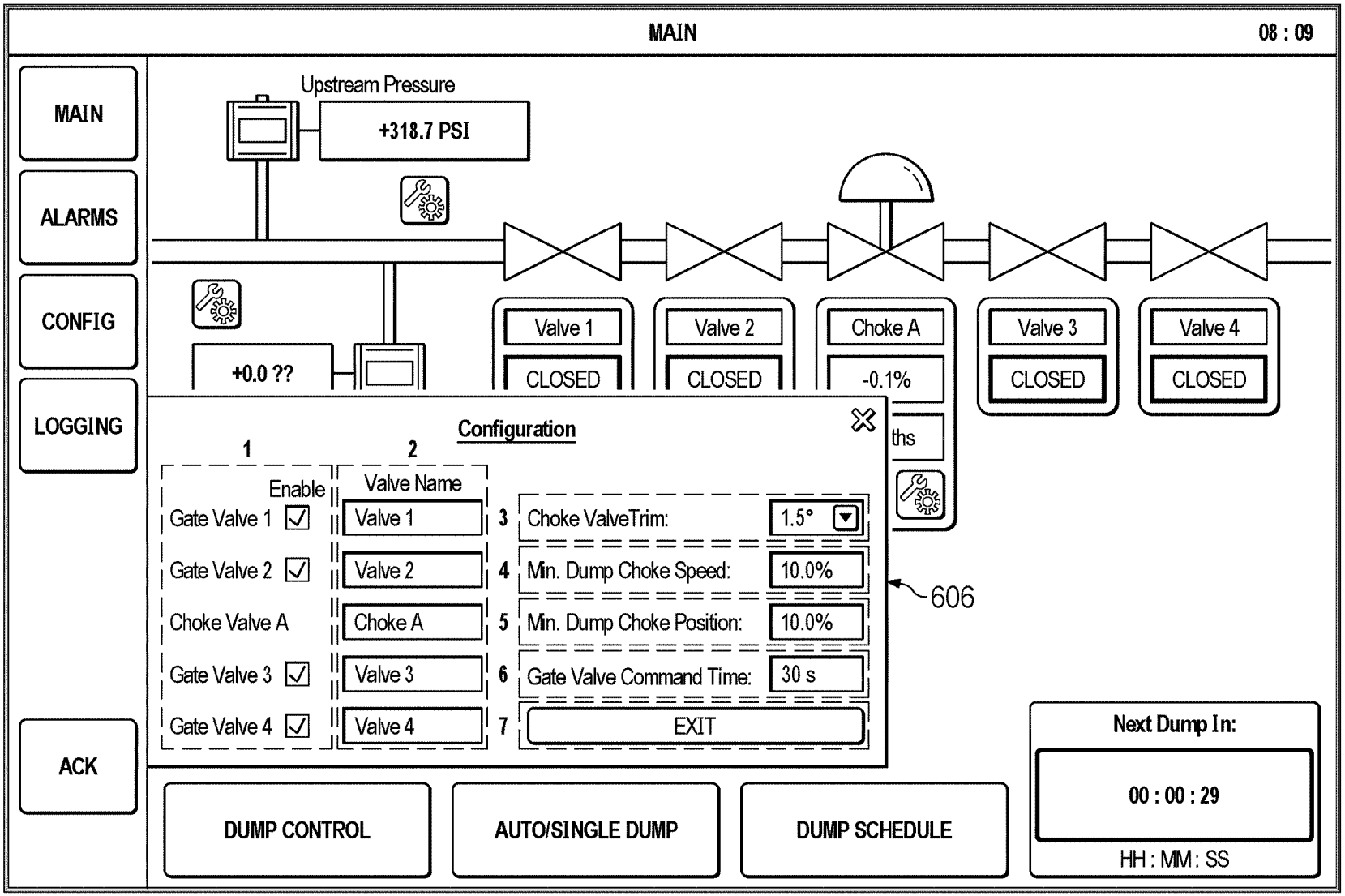
FIG. 9 illustrates the display screen of FIG. 6 with a yet another pop-up window for viewing and changing valve configurations in the sand dump system in accordance with a still further aspect.

Referring now to FIG. 9, there is illustrated the display screen 600 of the control unit with yet another pop-up window 606 opened in the lower portion of the screen for selecting a configuration of the system 300. The pop-up window 606 includes the following information displays and controls to control how the system dumps:

1. To enable or disable various plug/gate valves on the main screen (denoted "1").
2. On the main screen the valves are defaulted to be named Valve 1, Valve 2 etc. These can be renamed as required in this section (denoted "2") of the pop-up window 606.
3. In order to have the 64ths accurately calculated for the choke position on the main screen the choke trim size must be selected. The trim size can be selected in this box (denoted "3").
4. This box (denoted "4") allows setting the minimum speed the choke will open and close while dumping. On a scale of 0% as slow to 100% as fast. If this is set as a high number it will override that set in dump control screen.
5. This box (denoted "5") allows setting how far the choke will open when dumping. This box selects the minimum position the choke will open to. On the scale of 0% open to 100% open. If this is set as a high number it will override that set in dump control screen.
6. This box (denoted "6") sets the time for how long the system will send a signal to open and close the plug/gate valves. If this time is too low the plug/gate valve may not fully open or close. If this number is too high the dump sequence will take longer.
7. This button (denoted "7") exits the program and enters the computers desktop screen.

Figure 10:
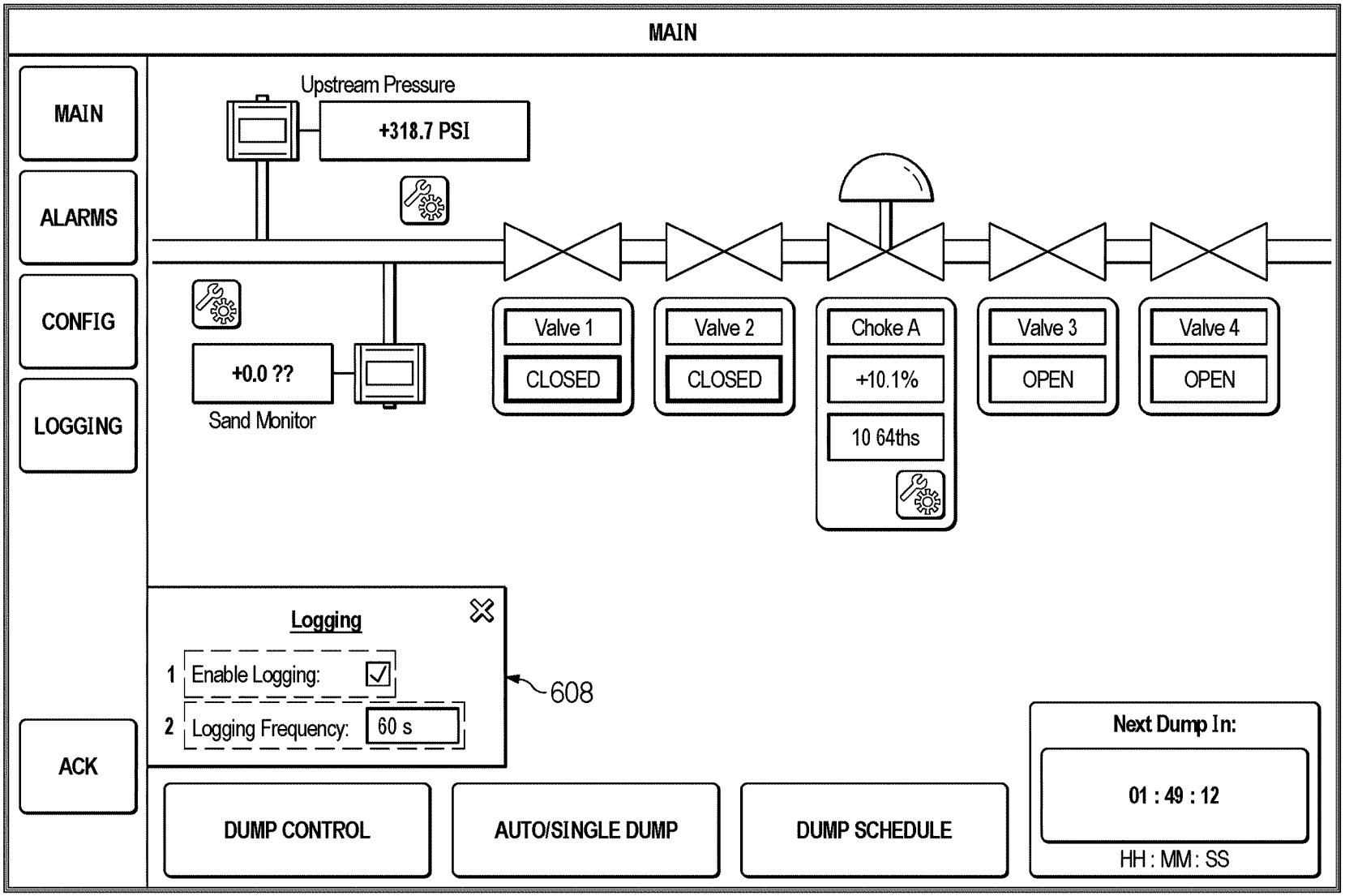
FIG. 10 illustrates the display screen of FIG. 6 with a further pop-up window for viewing and changing logging parameters in accordance with a still further aspect.

Referring now to FIG. 10, there is illustrated the display screen 600 of the control unit with a further pop-up window 608 opened in the lower left portion of the screen for selecting a logging option for the system 300. The pop-up window 608 includes the following information displays and controls to control how the system logs dumping information:

1. This box (denoted "1) sets the logging function to "on" or "off" mode.
2. This box (denoted "2") sets the frequency of the logging function (i.e., how often the results are recorded). In some embodiments, a 1 second logging interval is recommended.

Although the preferred embodiment has been described in detail, it should be understood that various changes, substitutions and alterations can be made therein without departing from the spirit and scope of the invention as defined by the appended claims.

What is claimed is:

1. An automated sand dump system for an oil and gas well, the well comprising a production wellhead for routing sand-bearing hydrocarbon fluids and water from the well into a production line, the automated sand dump system comprising:

a sand trap vessel having an outer wall defining an exterior and an interior cavity, the sand trap vessel further including a production inlet for receiving sand-bearing hydrocarbon fluids and water from a production line into an upper portion of the interior cavity, a production outlet for releasing hydrocarbon fluids and water from the upper portion of the interior cavity, and a sand dump outlet for releasing sand from a lower portion of the interior cavity;

an automated sand dump choke valve operably connected to the sand dump outlet to control the release of sand from the lower portion of the interior cavity by opening to release sand from the lower portion of the sand trap vessel and by closing to prevent the release of sand from the lower portion of the sand trap vessel;

a control unit including a processor, a memory, a communications interface, a display screen and a human-machine interface (HMI), all being operably interconnected to one another;

at least a first sensor operably attached to the sand trap vessel for measuring a first condition at the sand trap and producing a first sensor signal indicative of the first condition;

wherein at least the first sensor is operably connected to the control unit to provide the first sensor signal to the control unit;

wherein the processor evaluates at least the first sensor signal to produce a first reported value;

wherein the processor compares the first reported value to at least a first predetermined value stored in the memory to determine an effective sand level;

wherein, when the processor determines that the effective sand level has exceeded a predetermined sand level stored in the memory, the processor directs the control unit to execute a sand dump sequence; and wherein when executing a sand dump sequence, the control unit sends a first dump command to open the automated sand dump choke valve and subsequently sends a final dump command to close the automated sand dump choke valve; and further comprising a second sensor operably attached to the sand trap vessel for measuring a second condition at the sand trap and producing a second sensor signal indicative of the second condition; and wherein the second sensor is operably connected to the control unit to provide the second sensor signal to the control unit; and wherein the processor evaluates both the first sensor signal and the second sensor signal to produce the first reported value; and wherein:

the first sensor is a first acoustic noise sensor operably attached to the production inlet and the first condition is a first noise level produced by sand moving through the production inlet;

the second sensor is a second acoustic noise sensor operably attached to the production outlet and the second condition is a second noise level produced by sand moving through the production outlet;

wherein the processor evaluates both the first sensor signal and the second sensor signal to produce a reported differential noise level as the first reported value; and wherein the processor determines the effective sand level by comparing the reported differential noise level value to a minimum differential noise level value stored in the memory as the first predetermined value.

2. The automated sand dump system of claim 1, wherein the processor further determines the effective sand level by comparing the reported differential noise level value to the minimum differential noise level value and a maximum differential noise level value store in the memory as a second predetermined value.

3. The automated sand dump system of claim 1, wherein the processor uses the first sensor signal to determine a respective volume of sand entering the sand trap vessel during each respective time interval of a plurality of time intervals and sums the respective volumes of sand to provide a total volume of sand entering the sand trap vessel for the plurality of time intervals.

4. The automated sand dump system of claim 1, wherein the production wellhead further includes an automated production choke for controlling a volume of sand-bearing hydrocarbon fluids and water released from the well, and wherein the control unit is operatively connected to the automated production choke to selectively operate the automated production choke to change the volume of sand-bearing hydrocarbon fluids and water released from the well in response to a length of time between successive sand dump sequences.

5. The automated sand dump system of claim 4, wherein the control unit controls the production choke to further open when the length of time between successive sand dump sequences is greater that a preselected maximum interval stored in the memory.

6. The automated sand dump system of claim 4, wherein the control unit controls the production choke to further close when the length of time between successive sand dump sequences is less that a preselected minimum interval stored in the memory.

7. The automated sand dump system of claim 1, wherein while executing a sand dump sequence, the first dump command sent by the control unit commands the automated sand dump choke valve to open to a preselected percentage of full open.

8. The automated sand dump system of claim 7, the first dump command sent by the control unit commands the automated sand dump choke valve to open at a preselected rate to the preselected percentage of full open.

9. The automated sand dump system of claim 7, wherein after sending the first dump command, the control unit waits a preselected period of dwell time before sending the final dump command to close the automated sand dump choke valve.

10. The automated sand dump system of claim 1, further comprising a dump line sensor attached to the sand dump line for sensing a parameter indicative of whether sand or fluid is passing through the sand dump line and producing a parameter signal corresponding thereto;

wherein the dump line sensor is operably connected to the control unit to provide the parameter signal to the control unit;

wherein the processor compares the parameter signal to a predetermined value stored in the memory to determine if a sand-to-water transition is imminent; and wherein, when the processor determines that a sand-to-water transition is imminent, the processor sends the final dump command to close the automated sand dump choke valve.

* * * * *